United States Patent [19]

Lind et al.

[11] 4,267,960

[45] May 19, 1981

[54] BAG FOR VACUUM PACKAGING OF MEATS OR SIMILAR PRODUCTS

[75] Inventors: Keith D. Lind; Deane E. Galloway, both of Appleton, Wis.

[73] Assignee: American Can Company, Greenwich, Conn.

[21] Appl. No.: 70,734

[22] Filed: Aug. 29, 1979

[51] Int. Cl.[3] ..... B65D 33/02; B65D 81/14; B65D 85/00; B65B 25/00

[52] U.S. Cl. ..... 229/55; 229/53; 426/127; 426/129

[58] Field of Search ..... 426/127, 129, 124; 229/55

[56] References Cited

U.S. PATENT DOCUMENTS

| | | | |
|---|---|---|---|
| 2,891,870 | 6/1959 | Selby et al. | 426/124 |
| 3,264,165 | 8/1966 | Stickel | 428/310 |
| 3,342,613 | 9/1967 | Schelhorn | 426/127 |
| 3,363,750 | 1/1968 | Smith | 229/55 |
| 3,494,457 | 2/1970 | Titchenal | 229/55 |
| 3,587,839 | 6/1971 | Von Brecht | 426/129 |
| 3,625,348 | 12/1971 | Titchenal et al. | 426/129 |
| 3,653,927 | 4/1972 | Howell et al. | 426/124 |
| 3,741,253 | 6/1973 | Brax et al. | 426/127 |
| 3,741,778 | 6/1973 | Rowe | 426/113 |
| 3,912,823 | 10/1975 | Kane | 426/129 |
| 3,932,693 | 1/1976 | Shaw et al. | 426/127 |
| 3,948,436 | 4/1976 | Bambara | 229/55 |
| 3,949,135 | 4/1976 | Vercauteren | 426/127 |
| 3,955,040 | 5/1976 | Schirmer | 426/127 |
| 3,983,258 | 9/1976 | Weaver | 426/129 |
| 4,029,822 | 6/1977 | Comer | 426/129 |
| 4,101,711 | 7/1978 | Stillman | 426/127 |
| 4,136,203 | 1/1979 | Murphy et al. | 426/124 |
| 4,136,205 | 1/1979 | Quattlebaum | 426/127 |

FOREIGN PATENT DOCUMENTS

| | | | |
|---|---|---|---|
| 1397648 | 6/1975 | United Kingdom | 426/129 |
| 1440658 | 6/1976 | United Kingdom | 426/129 |

*Primary Examiner*—Steven L. Weinstein
*Attorney, Agent, or Firm*—Robert P. Auber; Ira S. Dorman; Thomas D. Wilhelm

[57] ABSTRACT

A multi-layer laminated meat package is disclosed which has a panel of the bag adapted for clear sight of the meat inside and another portion of the bag which has a boneguard panel constructed to resist puncture when drawn firmly over protruding bones in the meat. The bag is adapted to be evacuated after insertion of the meat so as to be drawn tightly over the meat, and to have the open end of the bag thereafter heat sealed together to complete the package. In addition, all interior surfaces of the bag are formed of heat sealable materials such that the completed package can be post heated after insertion of the meat to seal areas of the bag which have been drawn together during the evacuation. Embodiments of the bag are disclosed which have more than 50% of the surface of the bag covered by a boneguard panel. Boneguard panels which include a relatively thick layer of foamed plastic are also disclosed.

10 Claims, 13 Drawing Figures

BAG FOR VACUUM PACKAGING OF MEATS OR SIMILAR PRODUCTS

BACKGROUND OF THE INVENTION

1. Field of the Invention

This invention pertains generally to the field of heat sealable bags adapted for packaging meats and similar products, and particularly those which are adapted to be evacuated to draw the bag tightly around the meat product before the bag is sealed.

2. Description of the Prior Art

Cuts of meat are often packaged in plastic bags which are evacuated and heat sealed before delivery to the customer. Such packaging is particularly common with so called primal cuts of meat such as roasts and rib sections. Typically, such cuts of meats have substantial portions of bone remaining in them, and often the bones will protrude away from the meat itself. This can present a problem when evacuating the meat package, since sharp bones can puncture the walls of the bag.

In conventional vacuum packaged meats, a puncture of the bag wall will release the vacuum packaging on the meat and allow air to migrate around the bag, resulting in deterioration of the meat from contact with the air and considerable leakage of the fluids contained in the bag with the meat. This problem has been minimized by utilizing a post sealing treatment which involves heating the sealed package to cause heat sealable inner surfaces of the bag walls to seal together where these walls have been drawn together during the evacuation process. A bag sealed in this manner is mechanically held tight to the meat and will not generally separate from the meat if a portion of the bag is punctured. However, there will be drainage of fluid from the meat package and localized introduction of air into the package which can damage the meat.

Various types of boneguard inserts have been used with packaging of this nature. A conventional boneguard is a wax impregnated cloth or plastic insert which is hand placed over the exposed bone before the meat is inserted in the package. These inserts do not seal to the inner surface of the outer bag layers. Additional boneguard structures include separate layers of plastic which are sealed into the bag to cover those areas which will be exposed to the protruding bones. These structures have suffered from various limitations, including relative high cost of labor and materials involved in placing the inserts properly into the bag, and locating the meat so that the bone abuts the insert. In addition, the inserts often have not adequately protected the bag from the effects of protruding bones, so that punctures are still possible.

SUMMARY OF THE INVENTION

The bag of the invention is adapted for the packaging of meat having bone protrusions and includes at least one generally rectangular outer panel and at least one smaller, generally rectangular inner panel which is heat sealed to the inner surfaces of the outer layer and provides a guard against bone protrusions. The outer panel is formed as a coextrusion of an inner layer of thermoplastic heat sealable material, and an outer layer of plastic material which is not affected by heat sealing temperatures, such as nylon. The outer layer also provides structural strength to the package and preferably acts as a moisture and gas barrier. The inner boneguard panel is formed of a plastic material having outer surfaces which are heat sealable to allow sealing to the inner surfaces of the outer panel. The boneguard panel provides cushioning against any bones that may protrude from the meat being packaged.

In each of the embodiments disclosed, the inner boneguard panel is sealed to inner surfaces of the outer panel or panels at at least two side heat seals which run the length of the package, and along a back edge heat seal which closes the back end of the bag. The bag is so constructed that after insertion of a meat product into the bag, the front edges of the bag may be sealed together by pressing the front edges of the bag together under heat and pressure. All facing surfaces of the inner and outer panels at the front edge of the bag are formed of heat sealable material and will seal well together when heat sealing bars are applied to the outside surfaces of the package. All of the outer surfaces of the outer layer are formed of a material which is not affected by the temperature of the heat sealing bars.

The inner boneguard panel may comprise a multilayer coextruded laminate which has outer layers composed of heat sealable plastic resin and a core layer of plastic resin which has been foamed to give it greater thickness and cushioning effect. It has been found that the foamed layer greatly reduces the likelihood of a bone puncturing the boneguard panel, since the cushioning effect of the foam tends to naturally spread any strain applied by a sharp piece of bone to a small area of the boneguard.

All inner surfaces of the bag are heat sealable so that the bag is well adapted to a bag heating process after evacuation and sealing of the bag so as to firmly seal together adjoining surfaces of the bag which have been drawn together during evacuation of the bag.

Further objects, features, and advantages of the invention will be apparent from the following detailed description taken in conjunction with the accompanying drawings, showing preferred embodiments of a bag for the packaging of meat.

DETAILED DESCRIPTION OF THE INVENTION

Figure 1:
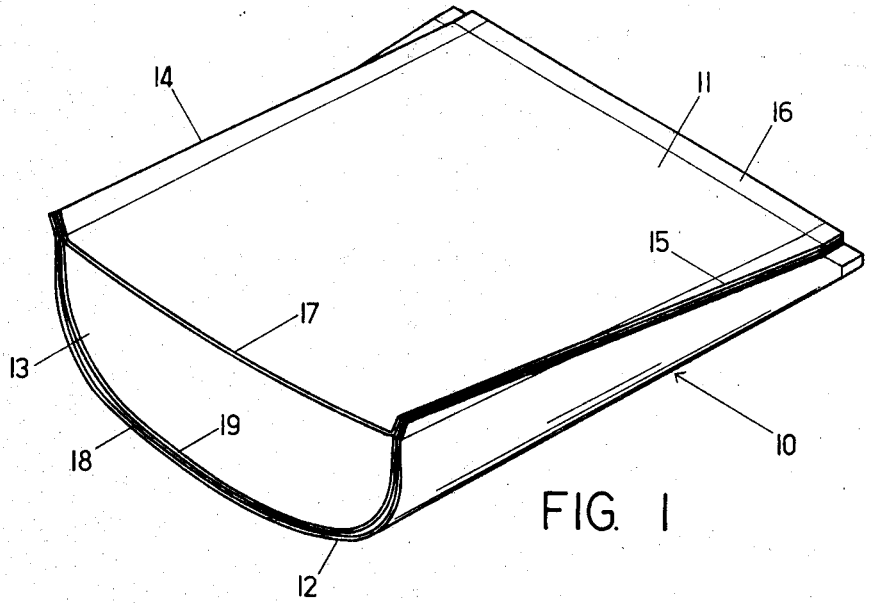
FIG. 1 is a perspective view of a meat packaging bag in accordance with the invention showing the open front end thereof.

With reference to the drawings, a preferred embodiment of a heat sealable meat packaging bag in accordance with the invention is shown generally at 10 in FIG. 1. The major structural layers of the bag are shown in somewhat exaggerated thickness in FIG. 1, and include a generally rectangular outer protective panel 11, a second rectangular outer panel 12, and an inner rectangular boneguard protective panel 13. The bag shown in FIG. 1 is open at its front so as to allow insertion of a meat product therein. The three panels forming the bag are heat sealed together along their side edges at side heat seals 14 and 15, and at their back edges at a heat seal 16.

Figure 2:
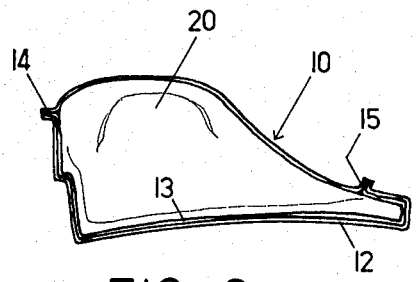
FIG. 2 is a cross-sectional view of a meat package in accordance with the invention with a meat product inserted therein, the package having been evacuated and sealed.

The meat product is inserted into the open front of the bag 10, the bag is evacuated, and the front edges 17, 18, and 19 of the layers 11, 12 and 13 respectively, are pressed together to seal the evacuated bag tightly about the meat product. A cross-sectional view through a packaged meat product is shown in FIG. 2, wherein the bag is illustrated tightly drawn about a meat product 20. As illustrated by the view of FIG. 2, the act of evacuating the inside of the bag draws the bag tightly against all of the surfaces of the meat product. The bag will thus be in contact with any protruding bones on the product. It has now been recognized, as a part of the present invention, that many meat products have protruding bones which extend over greater than 50% of the surface of the meat product, or in which the protruding bones are spaced apart in a manner so as to require a protective layer which encompasses more than 50% of the surface of the product. The bag 10 is so designed to provide protection against protruding bones in meat packages having this characteristic. Thus, the generally rectangular second outer panel 12 and the inner boneguard protective panel 13, which is substantially the same size and shape, are larger than the first outer panel 11. A preferred ratio is 60% of the surface area covered by the second outer panel 12 and 40% by the first outer panel 11. It is not necessary that the boneguard protective panel 13 extend entirely around the periphery of the bag since bone protrusions will not cover the entire surface of the product. It is desirable to cover less than the entire surface area of the bag with the boneguard since the boneguard panel may tend to obscure the view of the meat product inside. Moreover, since it is not necessary to have a boneguard layer around the entire periphery of the bag, to do so would add additional cost to the bag structure without providing additional advantage.

In order to obtain the bag structure shown in FIG. 1, the two parallel side edges of the first outer panel 11 must be substantially equal in length to the two parallel side edges of the second outer panel 12, as well as to the two parallel side edges of the inner boneguard panel 13. These equal length side edges are sealed together at the lateral edge seals 14 and 15. In order for more than one half of the bag to be covered by the boneguard 13, the remaining two front and back parallel edges of the boneguard panel 13 and the second outer panel 12 must be substantially longer than the remaining two front and back parallel edges of the first outer panel 11. After formation of the lateral heat seals 14 and 15, the back edge heat seal 16 is formed by pressing the back edges of each of the panels 11, 12 and 13 together under heat and pressure.

Figure 3:
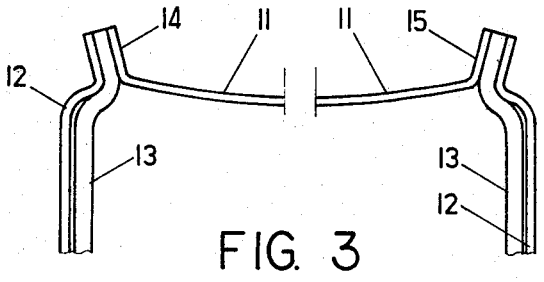
FIG. 3 is a view looking at the open front end of the bag shown in FIG. 1, with portions of the bag being broken away in the view to show only the essential features thereof.

The side edge seals 14 and 15 are shown in the partial front view of FIG. 3, wherein the thicknesses of the various panels have been exaggerated for purposes of illustration. In order to provide the heat seals 14 and 15, it is necessary that the inner surfaces of the outer panels 11 and 12 be heat sealable, as must the surfaces of the boneguard protective panel 13, since these respective surfaces will be facing one another at the time that the heat seals are made. The outer surfaces of the outer panels 11 and 12 are formed of a plastic material which is not affected by the temperatures required to make the heat seals.

At the remainder of the bag surface, the second outer panel 12 and the boneguard panel 13 are not sealed to one another. Thus, when a vacuum is applied to the open front end of the bag 10, any air between the panels 12 and 13 will be drawn out so that no pockets of air will be trapped between these panels.

Figure 5:
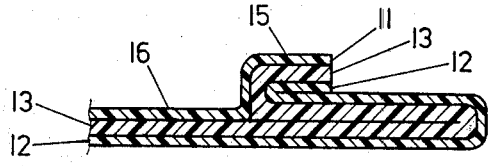
FIG. 5 is a cross-sectional view of a portion of the back edge heat sealed layers of the bag of FIG. 1.

A partial cross-sectional view through the heat seal area 16 is shown in FIG. 5, which particularly shows a section through the portion of the heat seal 16 which includes the lateral edge heat seal 15. As shown, a portion of the boneguard panel 13 is folded over at the edge of the bag and sealed to itself before terminating at the side edge at which it meets and is sealed to the first outer panel 11. The second outer panel is similarly folded over and sealed at the heat seal area 16. The heat and pressure applied at the seal area 16 causes the second outer panel 12 to be sealed to the boneguard panel 13 at all areas along the heat seal at which they adjoin. In addition, the first outer panel 11 is sealed to the boneguard panel 13 at all areas along the heat seal 16 at which these panels adjoin. Thus, it will be observed that all surfaces which define the interior end of the bag 10 at the back end of the bag are heat sealed together to form an air tight seal at the back end of the bag.

The structure of the back heat seal 16 in the area of the side seal 14 is the mirror image of the structure shown in FIG. 5. It should again be noted that the layer thicknesses are exaggerated for illustration.

Figure 4:
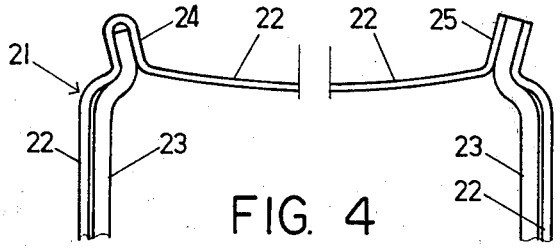
FIG. 4 is a view of an alternative embodiment of the bag shown in FIG. 1, looking at the open front end of the bag in a view equivalent to that shown in FIG. 3.

An alternative construction for the bag of FIG. 1 which utilizes only a single outer panel is shown in front view in FIG. 4. The construction of the bag 21 shown in FIG. 4 is substantially identical to that of the bag 10 shown in FIG. 1 except that the single rectangular outer panel 22 extends around one of the equal length side edges of the rectangular boneguard panel 23 at one of the heat seals 24. The outer panel 22 extends to the other heat seal 25 at which area it seals the other side edge of the boneguard panel 23 between the side edges of the outer panel.

Again, it is preferred that the boneguard panel 23 cover less than the total surface area of the bag but more than 50% of the surface area. This is accomplished by locating the first heat seal 24 at a position less than half-way around the periphery of the bag from the heat seal 25. The side edges of the outer panel 22 and of the boneguard panel 23 are substantially equal in length, while the front and back edges of the outer panel extend for the entire periphery of the bag while the front and back edges of the boneguard panel are substantially shorter. A portion of the outer panel 22 is folded over one of the side edges of the boneguard panel 23 at the heat seal 24 such that the inner surfaces of the outer panel adjoin the outer surfaces of the boneguard panel at the areas of the heat seal. These respective surfaces are formed of heat sealable material such that when the heat seal clamps apply heat and pressure at the seal area 24, a seal will be formed.

The back edge heat seal (not shown) is substantially the same as the heat seal 16 of the bag 10. The seal 25 is identical to that shown in FIG. 5 for the seal 15 and the back edge seal at the location of the heat seal 24 is virtually identical to that shown in FIG. 5 except that the outer panel 22 extends around the boneguard panel. Otherwise, the back edge seals between respective inner surfaces for the bag 21 are identical to those for the bag 10.

Various materials are suitable for forming the bags 10 and 21. Generally, the layers that form the outer surfaces of the outer panels 11, 12 and 22 must be able to withstand the sealing temperatures at which heat seals are formed at the inner surfaces of these materials without melting. Typical materials which would provide such good outer layer qualities are nylon and polyesters. However, since these materials do not form good heat seals, it is necessary to laminate thereto an inner layer of a material which will adhere well to the protective outer layer. For example, a material such as ionomer, such as is sold under the name Surlyn, is suitable for coextruding with a nylon outer layer. The ionomer layer has the capacity of forming good heat seals at moderate heat sealing temperatures, and is also adapted to provide good seals to itself during the post heating treatment after the bag has been evacuated and the front edges have been sealed together.

The inner boneguard panels 13 and 23 may be formed of a solid film of heat sealable plastic such as ionomer or a variety of other plastics, or they may be formed as a multi-layer laminate. If a laminated film is utilized, the outer surfaces of the laminate must be capable of forming good heat seals. It is preferred that the surfaces of the inner panels be compatible in heat sealing characteristics with the inner surfaces of the outer panels so that seals are formed between these surfaces during the post heat treatment. Thus, the materials of these respective surfaces should soften sufficiently to form heat seals at similar temperatures.

Figure 6:
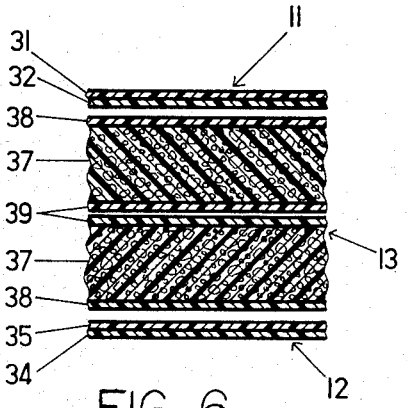
FIG. 6 is a cross-sectional view of the layers of the bag of FIG. 1 as taken at one of the side heat seals, with the layers being spaced slightly apart to better show the various layers.

An alternative multi-layer boneguard panel structure is shown in FIG. 6, which is a cross sectional view through the heat seal area 15 with the various layers of the package being shown slightly separated for purposes of clarity. The first outer panel 11 is formed of an outer layer 31 of plastic material which is not affected by heat sealing temperatures and an inner layer 32 of heat sealable thermoplastic material. Similarly, the second outer panel 12 is formed of an outer protective layer 34 of plastic material not affected by heat sealing temperatures and an inner heat sealable thermoplastic layer 35. As indicated above, examples of materials of which the outer protective layers can be formed include nylon and polyester, whereas the inner layers may be formed of such materials as ionomer, ethylene vinyl acetate and other materials adapted to adhere to the outer layers. Typical thicknesses for the outer layer are in the range of ½ to 1 mil. (12 to 25 microns) and the inner heat sealable layers 32 and 35 would be of similar dimensions. The boneguard panel 13 is formed of two separate coextruded multi-layer structures, which are thereafter pressed together. Each of the multi-layer structures include a central relatively thick core layer of foamed thermoplastic material 37 and outer layers of heat sealable plastic film 38 and 39. The double multi-layer construction may be formed easily by blown film coextruding the outer heat sealable layers about a inner core of foamed material into the typical tube formed by blown coextrusion, and thereafter collapsing the tube to press the walls of the tube together to form the double layer construction 13 shown in FIG. 6.

In accordance with the present invention, it has been discovered that highly desirable bone cushioning characteristics are obtained by a multi-layer sandwich structure such as that shown in FIG. 6, which includes a central core of foamed plastic material between layers of heat sealable thermoplastic with which the foamed layer is coextruded. Examples of materials of which such structures have been constructed include ionomer (metal salt neutralized polymer obtained from DuPont Corporation under the name Surlyn), ethylene vinyl acetate and combinations thereof. For example, the layers 37, 38 and 39 have been formed as a blown film coextrusion of a 12 mil thick layer of ionomer foam between ½ mil to 1 mil thick layers of ionomer, and a 12 mil thick ethylene vinyl acetate foam between an outer layer of ionomer and an inner layer of ethylene vinyl acetate each between ½ to 1 mil thick. Foaming of the core material was obtained by incorporating, at a level of 7% to 14% by weight of the core, a foaming agent consisting essentially of 90% low density polyethylene carrier and 10% azodicarbonamide as a blowing agent, which is obtained from the Ampacet Corporation as Ampacet 10104. Ionomer is a preferred outer layer since it will adhere well to itself and to the adjoining surfaces of the outer panels during the post-sealing heat treatment process.

As an alternative, a single coextrusion of layers 37, 38 and 39 may be utilized as the boneguard layer, in which case the foam layer 37 would preferably be 20 to 30 mils thick.

Modified bag embodiments in accordance with the present invention are shown in FIGS. 7–11.

Figure 7:
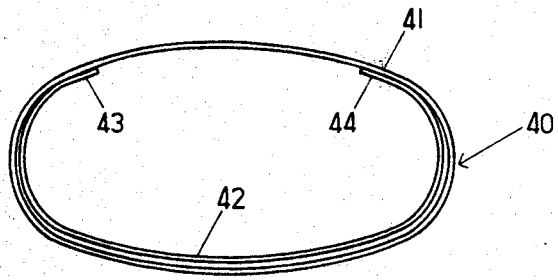
FIG. 7 is a front end view of an alternative embodiment of a bag in accordance with the invention wherein the outer panel is formed as a continuous tube.

In FIG. 7, a meat package is shown in front elevation view at 40 which includes a continuous tubular outer panel 41 and an inner boneguard panel 42 whose side edges are heat sealed to the inner surface of the tubular outer panel at heat seals 43 and 44. The side edges are equal in length to the length of the outer tube and the heat seals 43 and 44 run their length. The outer panel 41 is a tubular blown coextrusion of the type described above for the layers 11 and 12 of the bag 10, and has an inner surface layer formed of a layer of heat sealable thermoplastic material and a heat resistant outer surface layer. The rectangular boneguard panel 42 is formed as described above for the boneguard layer 13 and has surfaces composed of a heat sealable thermoplastic material. As is apparent from the view of FIG. 7, the facing inner surfaces of the panels forming the bag are heat sealable so that the ends can be easily heat sealed by pressing them between a heat sealing bar under heat and pressure. The facing back edges of the panels are heat sealed together (not shown) to form the completed open ended bag.

Figure 8:
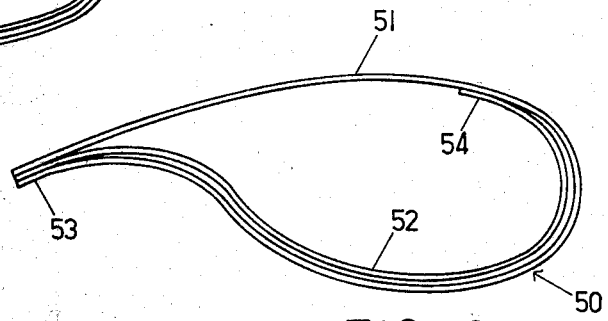
FIG. 8 is a front end view of another embodiment of the bag of the invention utilizing a single rectangular outer panel.

Another construction of a bag in accordance with the invention is shown generally at 50 in FIG. 8. The bag 50 is formed of a single rectangular outer panel 51 and an inner rectangular boneguard panel 52 which is sealed at one side edge in a heat seal 53 between the two side edges of the outer panel 51. The other side edge of of the boneguard panel 52 is sealed at a heat seal 54 to the inner surface of the outer layer 51 at a position intermediate the side edges of the outer panel. The side edges of the inner panel are equal in length to the side edges of the outer panel, while the front and back edges of the inner are substantially shorter than the front and back edges of the outer panel. The back edge of the inner panel is heat sealed along the folded over back edge thereof, with the remainder of the folded over back edge being heat sealed to itself. The structure of the outer panel 51 can be formed as described above for the outer panel 11, and the boneguard panel 52 can be formed as described above for the boneguard panel 13. Again, all facing inner surfaces of the various layers are heat sealable so that the open end of the bag can be heat sealed after the meat product has been inserted into the bag.

Figure 9:
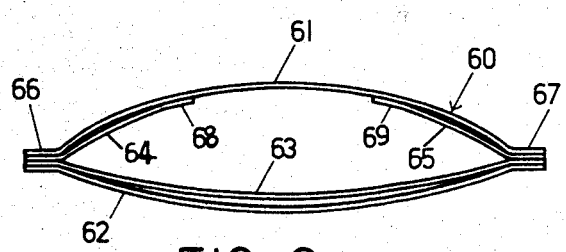
FIG. 9 is a front end view of another embodiment of the invention utilizing two outer panels and three inner boneguard panels.

Another embodiment of a bag in accordance with the invention which has more than 50% of its surface area covered by a boneguard panel is shown generally at 60 in FIG. 9. The bag 60 includes a first rectangular outer panel 61, a second rectangular outer panel 62, a first rectangular inner boneguard panel 63, and a pair of smaller rectangular inner boneguard panels 64 and 65. All of the panels have front, back and side edges, with all of the side edges of equal length. The side edges of panels 61, 62 and 63 are heat sealed together as well as the outer side edges of panels 64 and 65 at heat seals 66 and 67. In addition, the inner side edges of inner short panels 64 and 65 are heat sealed to the inner surface of the upper outer panel 61 which they face at heat seals 68 and 69 respectively. The outer panels 61 and 62 are formed as described above for the outer panel 11, and the boneguard panels 63, 64 and 65 are formed as described above for the boneguard panel 13. All facing surfaces at the back edges of the respective panels are heat sealed together to form the open ended bag.

Figure 10:
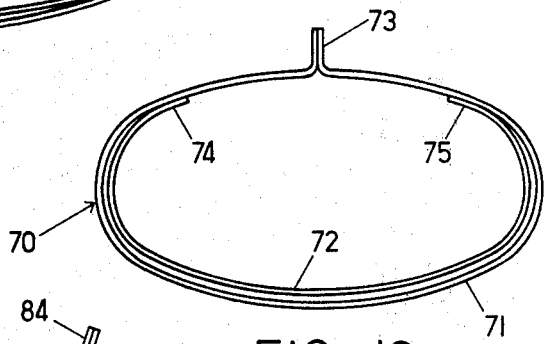
FIG. 10 is a front end view of another embodiment of the bag of the invention utilizing a single rectangular outer panel.

Another embodiment of the bag is shown generally at 70 in FIG. 10. The bag 70 includes a single rectangular outer panel 71 which has the inner surfaces of the side edges thereof sealed together in a heat seal 73 which runs the length of the bag. A single rectangular inner boneguard panel 72 is sealed to the inner surfaces of the outer panel 71 at heat seals 74 and 75 at positions spaced on either side of the heat seal 73. The length of the front and back edges of the inner boneguard panel 72 is preferably selected to be somewhat greater than half of the length of the front and back edges of the outer panel 71 so that the boneguard covers more than 50% of the surface area of the bag. The structure of the outer panel 71 corresponds to the structure described above for the outer panel 11, and the structure of the boneguard panel 72 corresponds to that of the boneguard panel 13. All facing surfaces at the back edges of the two panels are heat sealed together to form the open ended bag.

Figure 11:
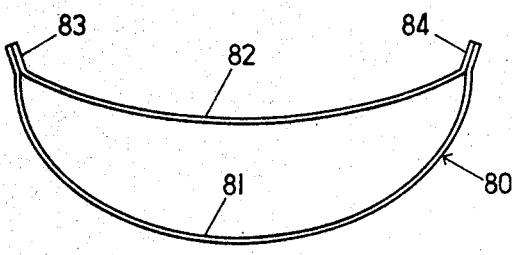
FIG. 11 is a front end view of an alternative embodiment of the bag of the invention wherein one of the two panels forming the bag incorporates a unitary multilayer boneguard structure.

Another embodiment of a bag in accordance with the invention is shown generally at 80 in FIG. 11. The bag 80 consists of a first rectangular panel 82 and a second rectangular panel 81, which also acts as a boneguard panel. The panels 81 and 82 have the inner surfaces at their side edges sealed together at heat seals 83 and 84. Each of the panels has front, back and side edges, with the side edges being equal in length. It is preferred that the length of the front and back edges of the boneguard panel 81 be greater than that of the first panel 82 so that the boneguard panel covers more than 50% of the surface area of the bag.

Figure 12:
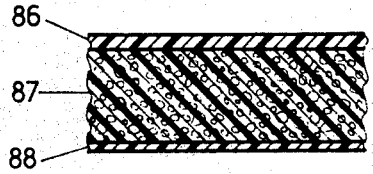
FIG. 12 is a cross-sectional view of the boneguard panel of the bag of FIG. 11.

The shorter outer panel 82 is preferably formed with a structure similar to that of the outer panel 11 of the bag 10. The boneguard outer panel 81, however, incorporates a multi-layer construction which provides good boneguard protective qualities. A first example of this structure is shown in FIG. 12 and comprises an outer layer 86 which is not affected by heat sealing temperatures, a core layer 87 of foamed plastic, and an inner heat sealable thermoplastic layer 88. For example, nylon in a thickness of 1 to 2 mils may be utilized for the outer layer 86, foamed ionomer in a thickness range of 20 to 30 mils may be utilized for the intermediate or core layer 87, and the inner heat sealable layer 88 may be formed of ionomer in a thickness of $\frac{1}{2}$ to 2 mils. Ionomer is a preferred material for contact with nylon in coextrusions because of its ability to adhere to the nylon layer.

Figure 13:
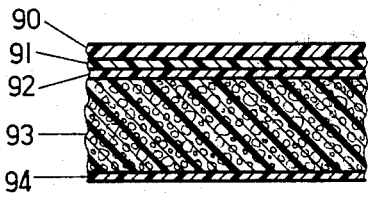
FIG. 13 is a cross-sectional view of an alternative construction for the boneguard panel of the bag shown in FIG. 11.

An alternative structure for the boneguard panel 81 is shown in FIG. 13. The structure 13 includes an outer protective layer 90 of material not affected by heat sealing temperatures, two intermediate layers 91 and 92, a central core layer 93 of foamed plastic, and an inner layer 94 of heat sealable thermoplastic material. The preferred thicknesses for the layers 90, 91, 92 and 94 would be in the range of $\frac{1}{2}$ to 2 mils, whereas the foamed core layer 93 would have a thickness of 20 to 30 mils. A suitable material for the three layers 92, 93 and 94 is ionomer, and the intermediate layer 91 may be formed of a material which has good adhesion to both nylon and ionomer, such as a polyolefin modified by the addition of functional groups thereto as sold under the name "Plexar" by the Chemplex Company and as disclosed in U.S. Pat. Nos. 4,087,587 and 4,087,588.

In both of the boneguard structures shown in FIGS. 12 and 13, the outer boneguard layer incorporates in a single unitary multi-layer structure both the relatively strong containment structure provided by the nylon layer and the cushioning effect provided by the intermediate core layer 87 of foamed plastic. It is seen that the inner surfaces of the boneguard structures shown in FIGS. 12 and 13 both have layers of heat sealable material so as to allow heat seals to be made at the surfaces.

In all of the embodiments described above, all facing surfaces of the various panels at the front of the bag are heat sealable. Thus, the bag can be closed by pressing the front edges of the bag panels together under heat and pressure after the product has been inserted.

It is understood that the invention is not confined to the particular construction and arrangement of parts herein illustrated and described, but embraces all such modified forms thereof as come within the scope of the following claims.

We claim:

1. An open ended bag adapted for the packaging of meat having bone protrusions, comprising:

(a) two outer rectangular panels each having front, back and side edges with the corresponding side edges of each panel being equal in length, the front and back edges of one of the panels being substantially longer than the corresponding front and back edges of the other panel so that the one panel is substantially wider than the other panel, each of said outer panels being formed of an inner layer of a thermoplastic heat sealable material and an outer layer of plastic material which is not affected by temperatures required to seal the heat sealable material;

(b) an inner boneguard panel, to resist puncture by the bone protrusions, with surfaces of heat sealable thermoplastic material and having front, back and side edges which are substantially equal in length to those corresponding front, back and side edges of said larger outer panel, said inner panel being secured at its side edges and along one of its back edges between and to said two outer panels by heat seals formed along said corresponding side edges of the two outer panels and by a heat seal formed along the entire length of the back edge of the smaller outer panel so that all three panels are secured and sealed together along their corresponding side edges and back edges, and with the portions of the back edges of the larger outer panel and the inner panel extending outwardly from the back edge of said smaller outer panel being folded over and heat sealed together, so that an open ended bag is formed to allow insertion of a meat product therein, with the boneguard panel being fixed in place co-extensive with the wider outer panel so that the bag has an inner panel of additional protective material extending over more than 50% of the inner surface of the bag, and all facing surfaces of said three panels at the open front end of the bag being heat sealable so that the bag may be closed by pressing the front edges of the bag panels together under heat and pressure after the product has been inserted.

2. The bag of claim 1 wherein said inner panel is formed of a coextrusion of a first layer of heat sealable plastic resin, an intermediate layer of foamed plastic resin, and an outer layer of heat sealable plastic resin.

3. The bag of claim 2 wherein said first layer, intermediate layer, and outer layer are formed of an ionomer resin.

4. The bag of claim 2 wherein said first layer is an ionomer resin film, said intermediate layer is foamed ethylene vinyl acetate resin, and said outer layer is ethylene vinyl acetate resin film.

5. The bag of claim 1 wherein said inner panel is a laminate of identical coextrusions of a first layer of heat sealable plastic resin film, an intermediate layer of foamed plastic resin, and an outer layer of heat sealable plastic resin film.

6. The bag of claim 5 wherein said first layer, intermediate layer, and outer layer are formed of an ionomer resin.

7. The bag of claim 5 wherein said first layer is an ionomer film, said intermediate layer is foamed ethylene vinyl acetate resin, and said outer layer is ethylene vinyl acetate resin film.

8. The bag of claim 1 wherein said outer panels are formed of a coextrusion of an outer layer of nylon film and an inner layer of ionomer resin film.

9. The bag of claim 1 wherein the boneguard panel covers about 60% of the surface area of the bag.

10. The bag of claim 1 wherein the surfaces of the boneguard panel are compatible in heat sealing characteristics with the inner surfaces of the outer panel and form heat seals at similar temperatures so that these respective surfaces will seal together during a post heat treatment.

* * * * *